US007405641B1

(12) United States Patent
Hsu et al.

(10) Patent No.: US 7,405,641 B1
(45) Date of Patent: Jul. 29, 2008

(54) MICRO-ELECTRO-MECHANICAL SWITCH

(75) Inventors: Tsung-Yuan Hsu, Westlake Village, CA (US); Adele Schmitz, Thousand Oaks, CA (US); David Chang, Calabasas, CA (US); Robert Loo, Agoura Hills, CA (US)

(73) Assignee: HRL Laboratories, LLC, Malibu, CA (US)

( * ) Notice: Subject to any disclaimer, the term of this patent is extended or adjusted under 35 U.S.C. 154(b) by 338 days.

(21) Appl. No.: 11/112,925

(22) Filed: Apr. 21, 2005

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 5,578,976 A 11/1996 Yao
5,638,946 A 6/1997 Zavracky
6,046,659 A * 4/2000 Loo et al. ..... 200/181
6,094,116 A * 7/2000 Tai et al. ..... 335/78
6,331,257 B1 12/2001 Loo et al.
6,962,832 B2 * 11/2005 Chou ..... 438/52

* cited by examiner

*Primary Examiner*—Elvin Enad
*Assistant Examiner*—Bernard Rojas
(74) *Attorney, Agent, or Firm*—Tope-McKay & Associates

(57) ABSTRACT

A micro-electro-mechanical switch is described. The switch comprises a substrate, with a signal transmission portion and an activation portion attached with the substrate. The activation portion includes an armature activation electrode positioned above a substrate activation electrode. The signal transmission portion includes a metal contact extending from a conducting transmission line and through a bottom insulating layer of the signal transmission portion, thereby being exposed for electrical contact. A mechanical linkage connects the activation portion with the signal transmission portion so that the activation portion and the signal transmission portion move in concert. When an activation signal is applied along the activation portion, both the activation portion and the signal transmission portion are drawn toward the substrate to a substantially closed position, where the metal contact of the signal transmission portion electrically contacts a signal transmission electrode.

34 Claims, 6 Drawing Sheets

MICRO-ELECTRO-MECHANICAL SWITCH

BACKGROUND OF THE INVENTION (1) Technical Field

The present invention relates to radio-frequency micro-electromechanical switches ("MEMS"), and more particularly, to high-power radio-frequency MEMS signal contact switches.

(2) Description of Related Art

In communications applications, switches are often designed with semiconductor elements such as transistors or pin diodes. At microwave frequencies, however, these devices suffer from several shortcomings. Pin diodes and transistors typically have an insertion loss greater than 1 dB, which is the loss across the switch when the switch is closed. Transistors operating at microwave frequencies tend to have an isolation value less than 20 dB. This allows a signal to "bleed" across the switch even when the switch is open. Pin diodes and transistors have a limited frequency response and typically only respond to frequencies below about 20 GHz. In addition, the insertion losses and isolation values for these switches vary depending on the frequency of the signal passing through the switches. These characteristics make semiconductor transistors and pin diodes a poor choice for switches in microwave applications.

U.S. Pat. No. 5,121,089, to Larson, disclosed a different class of microwave switch, termed the micro-electro-mechanical system (MEMS) switch. The MEMS switch has a very low insertion loss (less than 0.2 dB at 45 GHz) and a high isolation when open (greater than 30 dB). In addition, the switch has a large frequency response and a large bandwidth compared to semiconductor transistors and pin diodes. These characteristics give the MEMS switch the potential to replace traditional narrow-bandwidth PIN diodes and transistor switches in microwave circuits.

The Larson MEMS switch utilizes an armature design. One end of a metal armature is affixed to an output line, and the other end of the armature rests above an input line. The armature is electrically isolated from the input line when the switch is in an open position. When a voltage is applied to an electrode below the armature, the armature is pulled downward and contacts the input line. This creates a conducting path between the input line and the output line through the metal armature.

MEMS switches of the general type described above are, however, prone to premature failure. The cause of the premature failure is linked to the damage resulting from the impact of the armature contact with the substrate contact. Currently available MEMS switch designs have attempted to reduce the extent of damage. However, these designs still utilize beam type cantilever beam-type radio frequency (RF) MEMS switches which have double ohmic contact points that generally display a contact resistance of around 0.5 ohms. This contact resistance is the main limiting factor to the cycling number and power handling of existing MEMS switches.

More specifically, the dominant factor in limiting the lifetime of a switch is the edge contact of protrusion contacts upon activation. Edge contact allows less than 10% of the protrusion surface to contact with the bottom electrode. Thus, contact resistance is usually limited to around few hundred milliohms. Edge contact also causes excessive wear and tear during activation, resulting in an increased contact resistance, eventually causing catastrophic failure from heating.

Accordingly, there is a need in the art for a MEMS switch that is capable of high-power operation while avoiding premature failure due to increased impact per unit area. It is also desirable to have a MEMS switch which deters premature deterioration by reducing the amount of resistive heating due to increased current density through the small area of actual contact.

SUMMARY OF THE INVENTION

The present invention relates to a micro-electro-mechanical switch (MEMS). The MEMS comprises a substrate; an signal transmission line on top of the substrate, the signal transmission line having a first signal end and a second signal end where the first signal end is electrically isolated from the second signal end and with a signal transmission electrode located at the first signal end of the signal transmission line; an activation transmission line having a first activation end and a second activation end with a substrate activation electrode located between the first activation end and the second activation end; a signal transmission portion comprising a signal armature having a first signal armature end and a second signal armature end, the signal transmission portion comprising a top insulator layer and a bottom insulator layer with a conducting transmission line therebetween, where the conducting transmission line at the second signal armature end is electrically connected with the second signal armature end through a signal via/anchor formed through the bottom insulating layer of the signal transmission portion, where the signal transmission portion further comprises a metal contact at the first signal armature end extending from the conducting transmission line through the bottom insulating layer of the signal transmission portion, thereby being exposed for electrical contact, and being positioned such that as the signal armature is urged toward the substrate, the metal contact electrically contacts with the signal transmission electrode at the first signal end of the signal transmission line; an activation portion comprising an activation armature having a first activation end and a second activation end, the activation portion comprising a top insulator layer and a bottom insulator layer with a conductive layer formed therebetween, where a portion of the conductive layer proximate the substrate activation electrode is formed as an armature activation electrode and where the second activation end of the activation armature is electrically connected with the second end of the activation transmission line through a activation via/anchor formed through the bottom insulating layer so that an activation signal may be applied along the activation transmission line, drawing the armature activation electrode toward the substrate activation electrode, thus drawing the activation portion toward the substrate; and a mechanical linkage connecting the activation portion with the signal transmission portion so that the activation portion and the signal transmission portion move in concert; whereby when an activation signal is applied along the activation transmission line, both the activation portion and the signal transmission portion are drawn toward the substrate to a substantially closed position, where the metal contact of the signal transmission portion electrically contacts the electrode at the first signal end of the signal transmission line.

In another aspect, the portion of the conducting transmission line exposed for electrical contact is in the form of an protrusion, with the protrusion corresponding to the contact to be made between an input and an output, respectively; whereby the protrusion combined with movement of the activation armature and the signal armature to the substantially closed position provide a conformal contact between the conducting transmission line and the input and the output to form a circuit therebetween.

In yet another aspect, the conducting transmission line is formed from a titanium adhesive layer and a gold conductor layer and an anti-diffusion layer therebetween.

In another aspect, the present invention further comprises at least one anchor for mechanically attaching at least one of the following: the second activation end to the substrate and the second signal end to the substrate, wherein an attachment between the second activation end and the substrate includes a connection to a radio frequency line and a metal component for diffusing heat.

In yet another aspect, the armature activation electrode is positioned above the substrate activation electrode.

In another aspect, the mechanical linkage and the top and bottom insulator layers of the activation portion and signal transmission portion respectively, are formed of materials selected such that their mechanical and thermal properties provide a desired amount of bowing when the switch is activated.

In another aspect, the bottom insulator layer of the activation portion is formed as a layer on the substrate activation electrode.

The present invention also comprises a method of transmitting a radio frequency through a single contact micro-electro-mechanical switch. The method comprises acts of:

- transmitting an input signal through an input line located on top of a substrate;
- communicating the signal through a substrate electrode to an activation armature electrode located near but separated from the input line;
- electro-mechanically activating the switch;
- moving a mechanically linked activation armature and a signal armature to a substantially closed position;
- transmitting the signal across a conducting transmission line positioned over the input line and output line positioned in proximity to the signal armature;
- contacting at least a portion of the conducting transmission line exposed for conformal contact with the input and output lines; thereby
- enabling electricity to flow by closing a circuit between the output line and the input line.

The method further comprises an act of contacting an protrusion, wherein the contacting corresponds to the contact to be made between the input and the output; whereby the protrusion combined with movement of the activation armature and the signal armature to the substantially closed position provides a conformal contact between the conducting transmission line and the input and the output to form a circuit therebetween.

In another aspect, the conducting transmission line is formed from a titanium adhesive layer and a gold conductor layer and an anti-diffusion layer therebetween.

The method further comprises an act of attaching at least one the following: an end of the activation armature to the substrate and a signal end of the signal armature to the substrate, wherein attaching the activation end includes acts of connecting to a radio frequency line and diffusing heat through an anchoring comprised of a metal material.

The method further comprises an act of passing a signal through an activation armature electrode to the conducting line.

The method further comprises acts of activating the switch and creating a desired amount of bowing of the activation armature and the signal armature to facilitate the contacting of at least a portion of the conducting transmission line.

Finally, as can be appreciated by one in the art, the present invention also comprises a method for forming the micro-electro-mechanical switch described herein.

BRIEF DESCRIPTION OF THE DRAWINGS

The objects, features, and advantages of the present invention will be apparent from the following detailed descriptions of the various aspects of the invention in conjunction with reference to the following drawings where.

DETAILED DESCRIPTION

Figure 1:
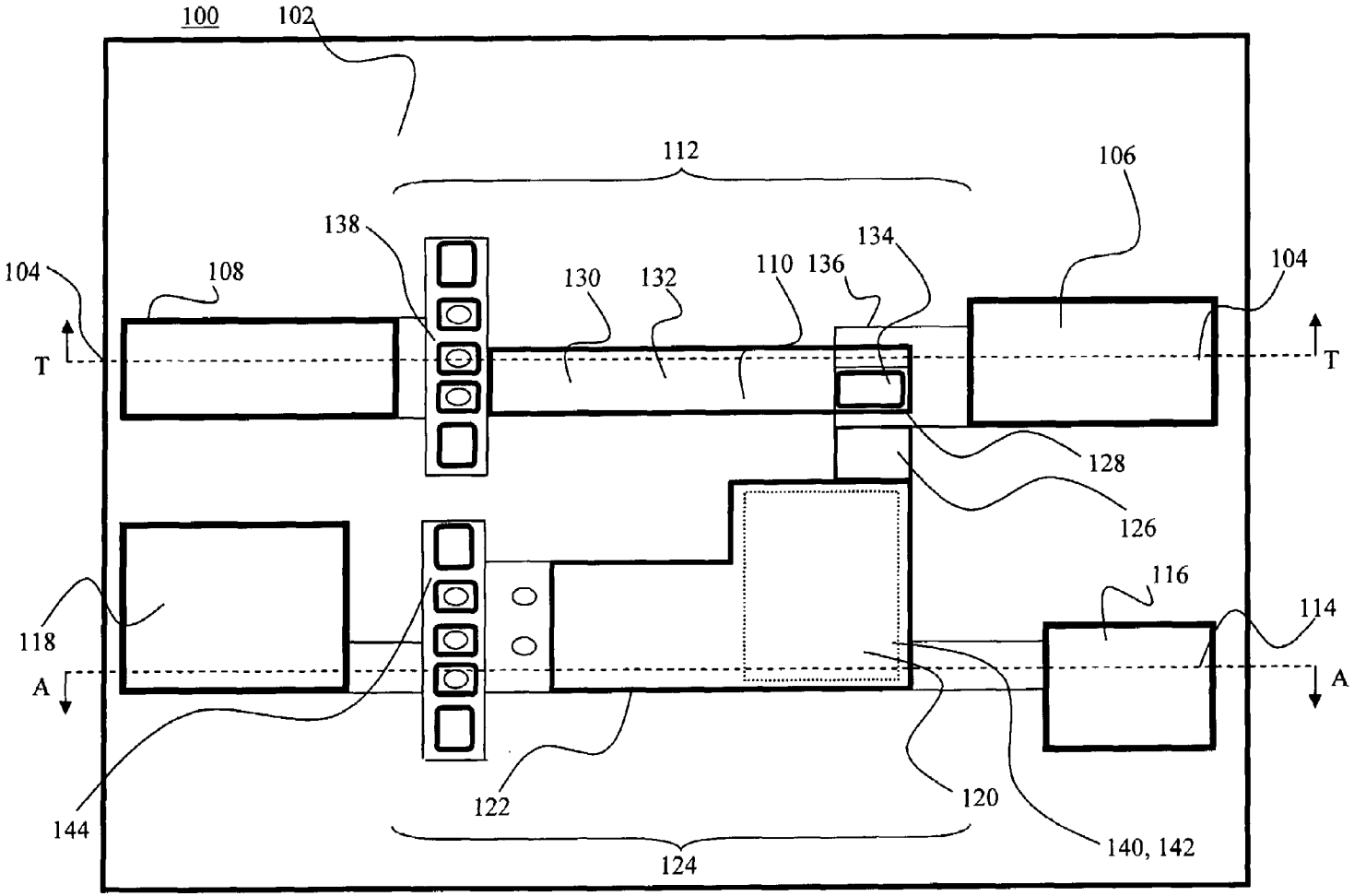
FIG. 1 is a top elevation view of a MEMS switch according to the present invention.

The present invention relates to radio-frequency micro-electromechanical switches ("MEMS"), and more particularly, to high-power radio-frequency MEMS signal contact switches. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles defined herein, may be applied to a wide range of aspects. Thus, the present invention is not intended to be limited to the aspects presented, but is to be accorded the widest scope consistent with the principles and novel features disclosed herein. Furthermore it should be noted that unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "act for" performing a specific function, is not to be interpreted as a "means" or "act" clause as specified in 35 U.S.C. Section 112, Paragraph 6. In particular, the use of "act of" or "act of" in the claims herein is not intended to invoke the provisions of 35 U.S.C. 112, Paragraph 6.

Before describing the invention in detail, first an introduction is provided to provide the reader with a general understanding of the present invention. Finally, a description of various aspects of the present invention is provided to give an understanding of the specific details.

A. Introduction

This invention teaches the provision of MEMS switch having a signal transmission portion and an activation portion connected by mechanical linkage. The activation portion includes a metal contact for conformally contacting a signal transmission electrode when the switch is actuated. The conforming nature of the contact provided by the present invention is intended to maximize the available contact area so that the contact resistance is minimized, and heat dissipation is improved. An existing simple cantilever beam type of RF MEMS switch such as the RF switch disclosed in U.S. Pat. No. 6,046,659, and incorporated by reference herein in its entirety, is an example of a switch having the disadvantages of making edge contact as the switch is snapped down. The contact area in this older switch is usually around 10 microns$^2$ of the total protrusion (metal contact) size of greater than 100 microns$^2$. Over time, the impact caused when the edge of the metal contact on the cantilever beam non-conformally contacts an electrode on the substrate, resulting in excessive wear and premature failure. This excessive wear is the primary limiting factor to the number of cycles that the switch will accommodate prior to failure. The present invention simultaneously increases switch cycle-lifespan and substantially increases switch power handling capacity, as compared to conventional RF switches.

The switch can be fabricated using existing fabrication processes including those disclosed in U.S. Pat. No. 6,046,659. Reliability studies on existing radio-frequency MEMS switches indicate that a dominant factor limiting the switch cycling times is the nature of the edge contact of protrusions upon activation. Edge contact in such switches is such that less than 10% of the metal contact (protrusion) surface touches an electrode on the substrate. This limitation on contact area results in a two-fold problem: First, a smaller contact area necessarily results in greater impact-related damage to the MEMS switch, resulting both from a concentrated point of impact and, as a result of the concentrated point of impact, an inferior connection and associated increased resistive (Joule) heating. Both of these problems contribute to premature failure and inferior performance. The larger contact area provided by the present invention results in superior contact, better heat dissipation and power handling, and simultaneously reduces the impact related damage at the point of contact.

Switches according to the present invention benefit from higher reliability and higher power handling capability than RF MEMS switches currently available in the art and have the potential to be used, as non-limiting examples, in antenna diversity applications, base station switching, and cell phone handset transmit/receive modules. Experimental results have shown that the structures according to the present invention reduce the likelihood of premature impact-related failure and also assure conformal contact between a metal contact on a signal armature, thus minimizing contact resistance. Furthermore, a mechanical linkage between a signal transmission portion and a activation portion helps to provide a large contact force to assure a firm contact upon activation. This type of switch also has an improved power-handling capability, as heat dissipation is improved by the much larger contact area.

B. Description of Various Aspects

An illustration of a top view of a micro-electro-mechanical (MEM) switch 100, according to the present invention, is shown in FIG. 1. The switch 100 is formed on a substrate 102. Disposed on the substrate 102 is a signal transmission line 104 having a first signal end 106 and a second signal end 108, where the first signal end 106 and the second signal end 108 are electrically separated from each other by an area under a signal armature 110 of a signal transmission portion 112. For clarity, the dotted line 104 represents a general axis of an alignment of the metal components that form the signal transmission line 104. Also disposed on the substrate 102 is an activation transmission line 114 having a first activation end 116 and a second activation end 118, where the first activation end 116 and the second activation end 118 are electrically separated and where a substrate activation electrode 120 is formed therebetween in an area proximate an activation armature 122 of an activation portion 124. The dotted line 114 represents the general axis of an alignment of the metal components which form the activation transmission line 114.

As mentioned, the switch 100 includes a signal transmission portion 112 and an activation portion 124 connected by a mechanical linkage 126. The signal transmission portion 112 is typically in the form of a cantilever beam having a signal armature 110 having a first signal armature end 128 and a second signal armature end 130. The signal armature 110 includes a conducting transmission line 132 running between the first signal armature end 128 and the second signal armature end 130 (as will be shown in FIGS. 2A, 2B, 3A, and 3B, the conducting transmission line 132 lies between two insulating layers). A metal contact (protrusion) 134 is formed at the first signal armature end 128, so that when the switch 100 is actuated, the metal contact 134 permits electrical contact between the conducting transmission line 132 and a signal transmission electrode 136 formed on the first signal end 106 of the signal transmission line 104. The signal armature 110 is connected with the substrate 102 by a signal via/anchor 138. The signal via/anchor 138 also serves to electrically connect the conducting transmission line 132 with the second signal end 108 of the signal transmission line 104.

The activation armature 122 of the activation portion 124 includes a conductive layer 140 formed, in the activation armature 122, as an armature activation electrode 142. The armature activation electrode 142 resides proximate the substrate activation electrode 120, close enough so that when activated, an electromagnetic force between the substrate activation electrode 120 and the armature activation electrode 142 draws the activation armature 122 toward the substrate 102. Like the conducting transmission line 132 of the signal armature 110, the conductive layer 140 of the activation armature 122 lies between two insulating layers (as will be shown in FIGS. 2A, 2B, 3A, and 3B). The activation armature 122 is connected with the substrate by an activation via/anchor 144, through which the conductive layer 140 is in electrical communication with the second activation end 118 of the activation transmission line 114. The via/anchor 144 mechanically attaches the second activation end 118 to the substrate 102 and/or the second signal end 108 to the substrate 102. The attachment between the second activation end 118 and the substrate 102 includes a connection to a radio frequency line and a metal component for diffusing heat.

Thus, in operation, a signal is passed along the activation transmission line 114 causing an electromagnetic force to pull the activation armature 122 toward the substrate 102. The signal armature 110 is pulled along with the activation armature 122 toward the substrate 102 by the mechanical linkage 126 so that the metal contact 134 contacts the signal transmission electrode 136, closing a circuit between the first signal end 106 and the second signal end 108 of the signal transmission line 104, thus permitting the passage of a transmission signal such as a radio-frequency (RF) communication signal.

Note that in the description above, as well as in descriptions that follow, unless specifically noted otherwise, the terms "first," "second," "input," and "output" are used merely as labels for convenience. It should be appreciated that these terms are not intended to imply a specific ordering of operations or elements and that the terms may be used interchangeably.

Figure 2A:
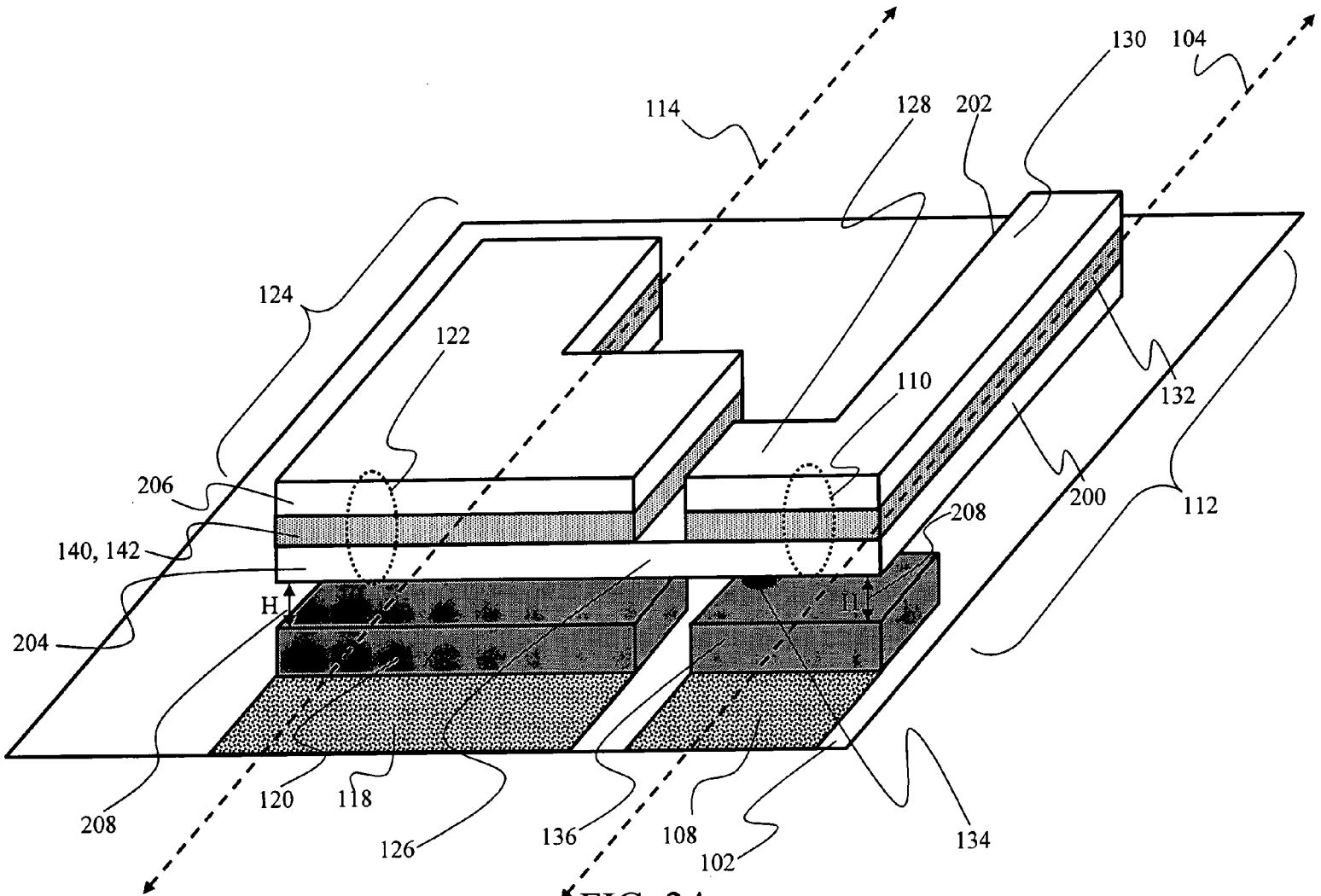
FIG. 2A is a perspective view of the MEMS switch depicted in FIG. 1 in an "open" state.

The top view shown in FIG. 1 provides an incomplete picture of the structure of the switch 100, as one cannot discern the various layers of which it is comprised. In order to assist in providing a better understanding of the various components of a switch 100 according to the present invention, perspective views of the switch 100 from FIG. 1 are presented in FIGS. 2A and 2B, in open and closed positions, respectively. As shown in FIG. 2A, a substrate 102 has a signal transmission line 104 and an activation transmission line 114 formed thereon. A portion of the signal transmission line 104 is formed as a signal transmission electrode 136 and a portion of the activation transmission line 114 is formed as a substrate activation electrode 120. The signal transmission line 104 is formed proximate the location of the signal transmission portion 112 of the switch 100, while the activation transmission line 114 is formed proximate the location of the activation portion 124.

The signal transmission portion 112 comprises a bottom insulating layer 200 and a top insulating layer 202 with the conducting transmission line 132 formed therebetween. The signal transmission portion 112 also includes a metal contact 134 formed thereon such that the metal contact 134 is also in electrical contact with the conducting transmission line 132. The metal contact 134 is formed such that when the switch is closed, the metal contact 134 electrically connects with the signal transmission electrode 136. The signal transmission portion 112 is mechanically connected with the activation portion 124 by the mechanical linkage 126. It is important to note also that although the mechanical linkage 126 is shown as an extension of the bottom insulating layer 200, it could be formed from a combination of layers (as long as the conducting transmission line 132 of the signal transmission portion 112 remains electrically isolated from a conductive layer 140 of the activation portion 124).

Like the signal transmission portion 112, the activation portion 124 has a multi-layer structure. A bottom insulating layer 204 is formed proximate the substrate 102 with the conducting layer 140 formed thereon and with a top insulating layer 206 formed such that the conducting layer 140 resides between the bottom insulating layer 204 and the top insulating layer 206. An armature activation electrode 142 is formed in the activation armature 122 such that the armature activation electrode 142 is proximate the substrate activation electrode 120.

Figure 2B:
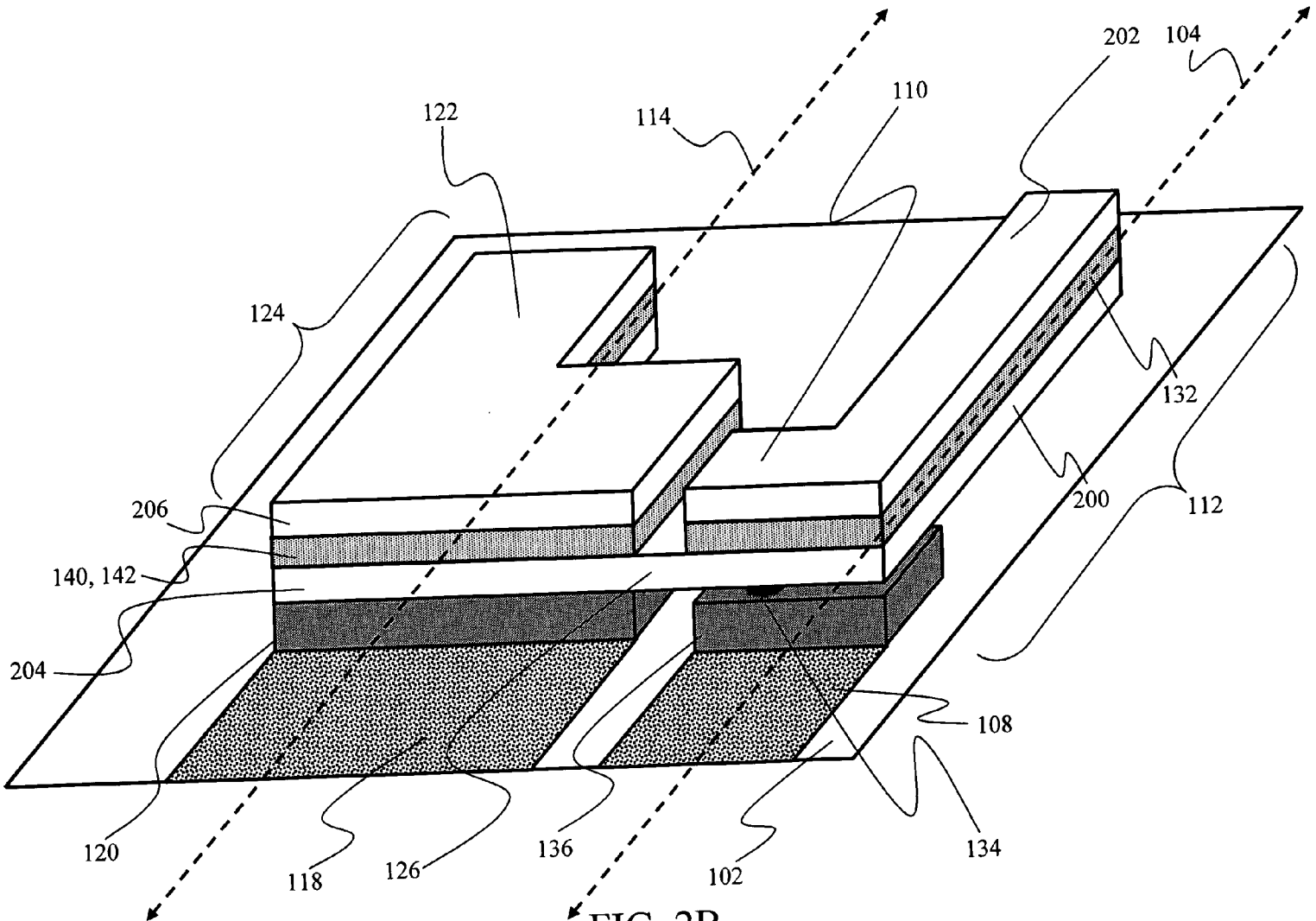
FIG. 2B is a perspective view of the MEMS switch depicted in FIG. 1 in a substantially "closed" state.

Note that the armature activation electrode 142 is formed such that even when the switch 100 is closed, the armature activation electrode 142 is separated from the substrate activation electrode 120 by the bottom insulating layer 204. This is unlike the metal contact 134 of the signal transmission portion 112, which is electrically connected through the bottom insulating layer 200 to the conducting transmission line 132 in order to allow electricity to pass through the metal layer 132. Also note that only portions of the signal transmission portion 112 and the activation portion 124 are shown in FIGS. 2A and 2B (the part to the right of the signal via/anchor 138 and the activation via/anchor 144). The signal transmission portion 112 and the activation portion 124 are connected by an insulating material mechanical linkage 126.

As previously stated, the portion of the switch 100 shown in FIG. 2A is depicted in an open position with the signal transmission portion 112 and the activation portion 124 residing at a height H 208 above the signal transmission electrode 136 and the substrate activation electrode 120, respectively. The switch 100 is shown in a closed position in FIG. 2B. The signal transmission portion 112 is nearly flush with the signal transmission electrode 136 of the signal transmission line 104, with the metal contact 134 being in conformal contact with the signal transmission electrode 136. The activation portion 124 is even more nearly flush with the substrate activation electrode 120. The mechanical linkage 126 acts as a torsion spring connecting the signal transmission portion 112 with the activation portion 124. Thus, when the activation portion 124 is pulled toward the substrate activation electrode 120, the signal transmission portion 112 is pulled toward the signal transmission electrode 136 of the signal transmission line 104 so that contact is made between the metal contact 134 and the signal transmission electrode 136 so that electricity can flow through the conducting transmission line 132 along the signal transmission portion 112. When electricity is no longer passed through the activation transmission line 114, the electromagnetic attraction force between the substrate activation electrode 120 and the armature activation electrode 142 ceases and the switch 100 returns to its original position as shown in FIG. 2A.

The layers of the switch 100 may be formed of a variety of materials known to those of skill in the art. For example, the metal contact 134 and the metal layer forming the conductive transmission line 132 and the conductive layer 140 may be formed of gold, titanium, or other conductive metals. As another non-limiting example, the conducting transmission line 132 may be formed from a titanium adhesive layer and a gold conductor layer, with an anti-diffusion layer therebetween. The bottom insulating layer 200 and the top insulating layer 202 of the signal transmission portion 112 as well as the bottom insulating layer 204 and the top insulating layer 206 of the activation portion 124 may be made of silicon-based materials such as silicon nitride and silicon dioxide, or other Type III-V semiconductor materials. Silicon nitride is desirable as a material because it can be deposited so that neutral stress exists in structural layers it forms. Neutral stress fabrication reduces bowing that may occur when the switch 100 is actuated. Depending on the stresses between individual layers that comprise the switch 100, the switch 100 may bow upward or downward. Bowing can change the voltage required to activate the switch 100 and, if the bowing is severe enough, can prevent the switch from either opening (when bowed in a downwardly concave shape) or closing (when bowed in an upwardly concave shape) regardless of the actuating voltage. Therefore, it is desirable to select materials for the switch 100 in order to provide a desired (typically minimal) level of bowing. The selection of combinations of different materials can also be made to provide a customized level of bowing. Essentially, the mechanical linkage 126 and the top and bottom insulator layers of the activation portion 124 and signal transmission portion 112 respectively, are formed of materials selected such that their mechanical and thermal properties provide a desired amount of bowing when the switch is activated.

As was shown in FIGS. 2A and 2B, the metal contact 134 is desirably in the form of a protrusion. When the switch 100 is open, the contact 134 is suspended and not in contact with the signal transmission electrode 136. The switch design permits the metal contact 134 to make contact without requiring the activation portion 124 to be completely snapped down, thus significantly reducing the contact resistance.

Figure 3A:
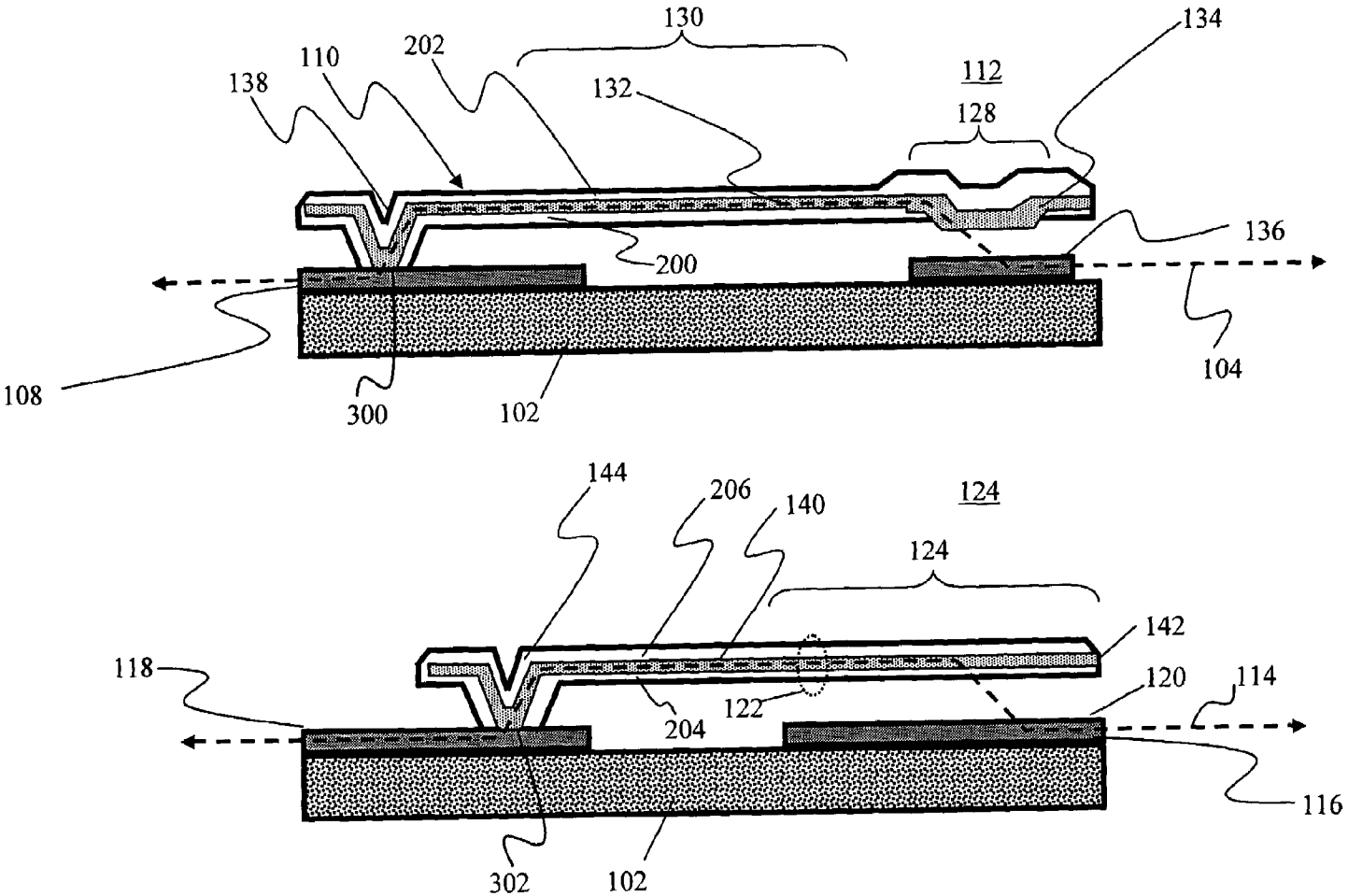
FIG. 3A is a left side view of an activation armature and a right side elevation view of a signal armature of the MEMS switch shown in FIG. 1, where the switch is in an "open" state.
Figure 3B:
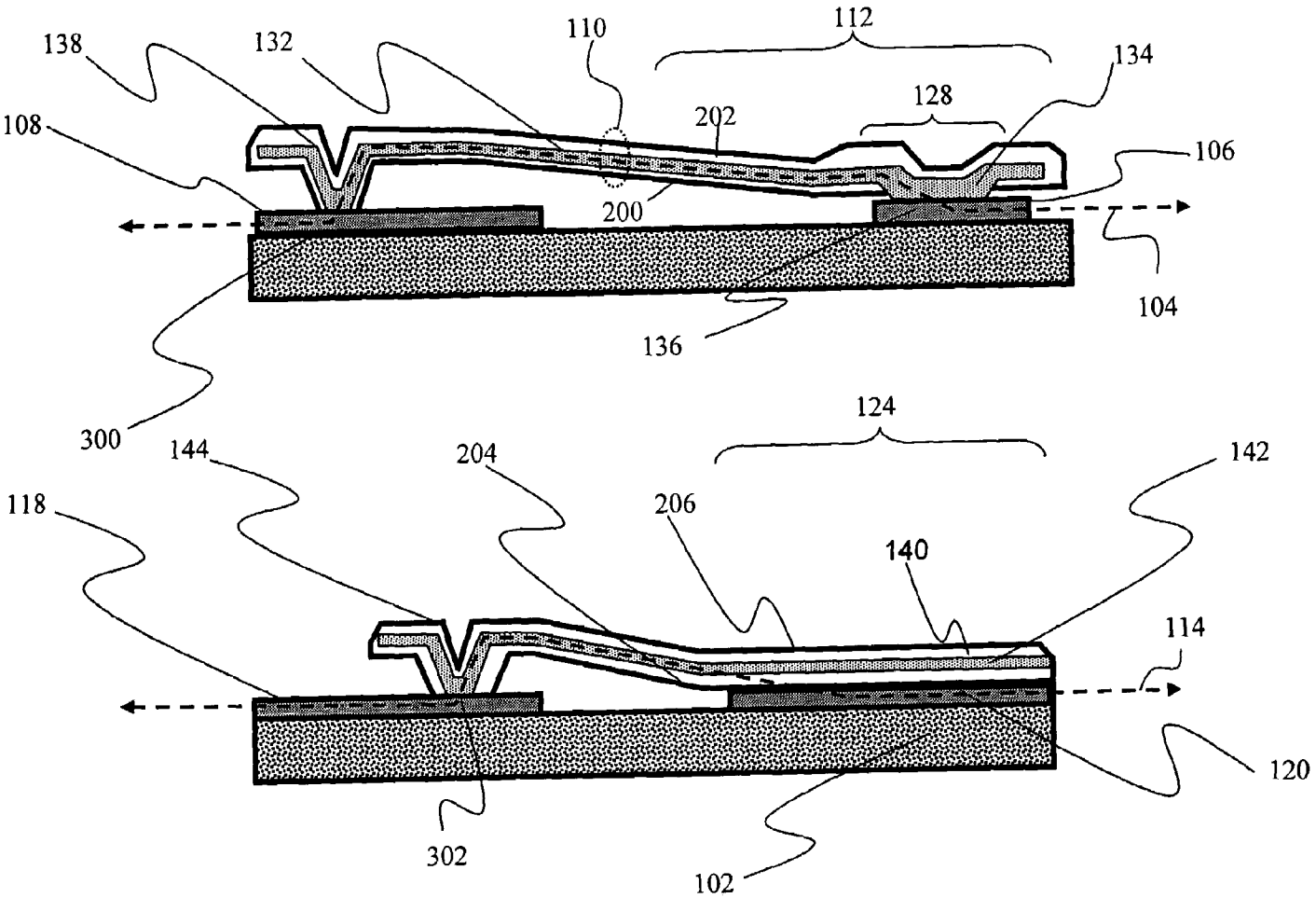
FIG. 3B is a left side view of an activation armature and a right side elevation view of a signal armature of the MEMS switch shown in FIG. 1, where the switch is in a "closed" state.

Next, FIGS. 3A and 3B each present side views of the signal transmission portion 112 and the activation portion 124 in open and closed positions, respectively. The side views provide a clearer view of the various layers in the switch. The cross sections of the signal transmission portion 112 are taken along line T-T in FIG. 1, and the cross sections of the activation portion 124 are taken along line A-A in FIG. 1.

The signal transmission portion 112 and the activation portion 124 of the switch 100 are shown in an open position in FIG. 3A. Both portions, as was shown in FIGS. 2A and 2B, are comprised of a metal layer 132 and 140, formed between two insulating layers, 200 and 202, and 204 and 206 respectively. With regard to the signal transmission portion 112, the conducting transmission line 132 at the second signal armature end 130 of the signal armature 110 is electrically connected with the second signal end 108 via electrode 300. The electrode 300 is formed as part of the second signal end 108 of the signal transmission line 104 through a signal via/anchor 138. The metal contact 134 is formed at the first signal armature end 128 of the signal armature 110. Thus, the signal via/anchor 138 serves both as a via through which an electrical signal may be passed when the switch 100 is closed (completing a circuit through the signal transmission line 104) and as a mechanical link, anchoring the signal armature 110 and supporting it above the substrate 102.

Like the signal transmission portion 112, the activation portion 124 is connected with the substrate 102 via an electrode 302. The electrode 302 is formed as part of the second activation end 118 of the activation transmission line 114. This connection occurs through an activation via/anchor 144 which, similar to the signal via/anchor 302, serves both as a via through which an electrical signal may be passed to close the switch 100 (drawing the armature activation electrode 142 toward the substrate activation electrode 120) and as a mechanical link, anchoring the activation armature 122 and supporting it above the substrate 102.

When a signal is applied to the activation transmission line 114, the armature activation electrode 142 is urged downward toward the substrate activation electrode 120 by an electrostatic force. When the switch 100 is activated (i.e., a signal is passed along the activation transmission line 114, pulling the activation portion 124 toward the substrate 102, the mechanical linkage 126 (not visible in FIG. 3A or 3B) pulls the signal transmission portion 112 along with the activation portion 124 so that the metal contact 134 electrically contacts the signal transmission electrode 136, permitting a signal to flow through the conducting transmission line 132 of the signal armature 110 and completing a circuit along the signal transmission line 104. The result of the switch's activation is shown in FIG. 3B.

Because contact is made using a single contact, rather than multiple contacts like the prior art, the present invention provides a much more conformal and efficient contact, reducing heating and spreading the impact over a larger area. Typically, the metal contact 134 is formed such that when the switch 100 closes, it is the first portion of the switch 100 (aside from the already-connected portions—the signal via/anchor 138 and the activation via/anchor 144) to make contact with the electrodes (specifically, the signal transmission electrode 136) formed on the substrate 102. The force of the contact between the metal contact 134 and the signal transmission electrode 136 is primarily dependent on the movement of the signal transmission portion 112 caused by the activation portion 124 as well as the geometry of the metal contact 134, and not on the attractive forces between the armature activation electrode 142 and the substrate activation electrode 120.

Figure 4:
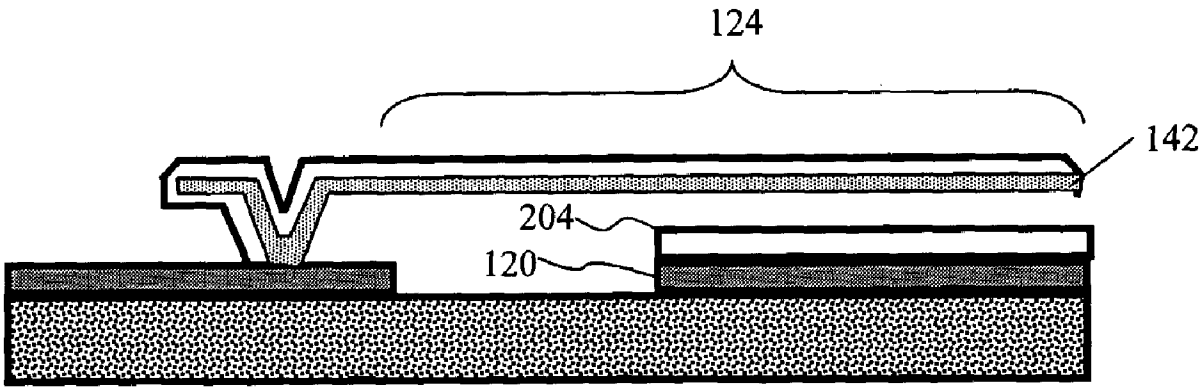
FIG. 4 is a left side view of another aspect of an activation armature, where a bottom insulator layer of the activation portion is formed as a layer on a substrate activation electrode.

In another aspect, as shown in FIG. 4, the bottom insulator layer 204 of the activation portion 124 may be formed as a layer on the substrate activation electrode 120. In this aspect, although the armature activation electrode 142 is exposed, it is electrically separated from the substrate activation electrode 120 by the insulator layer 204.

Finally, it is worth noting that MEMS switches that do not have metal contacts 134 in the form of extrusions (i.e., protrusion) have contacts that depend on armature flexibility and bias strength, factors which vary with the temperature, age, and the amount of use of the MEMS switch. In addition to improving the switch's operation life cycle, the quality of the contact itself is improved by the addition of the inverted protrusion because the protrusion has a controllable size and surface texture, characteristics that are dependent on the fabrication rather than on the environment. Thus, MEMS switches without such a metal contact 134 are more likely to have time-varying contact characteristics, a feature that may make them difficult or impossible to use in some circuit implementations.

What is claimed is:

1. A micro-electro-mechanical switch comprising:

a substrate;

an signal transmission line on top of the substrate, the signal transmission line having a first signal end and a second signal end where the first signal end is electrically isolated from the second signal end and with a signal transmission electrode located at the first signal end of the signal transmission line;

an activation transmission line having a first activation end and a second activation end with a substrate activation electrode located between the first activation end and the second activation end;

a signal transmission portion comprising a signal armature having a first signal armature end and a second signal armature end, the signal transmission portion comprising a top insulator layer and a bottom insulator layer with a conducting transmission line therebetween, where the conducting transmission line at the second signal armature end is electrically connected with the second signal armature end through a signal via/anchor formed through the bottom insulating layer of the signal transmission portion, where the signal transmission portion further comprises a metal contact at the first signal armature end extending from the conducting transmission line through the bottom insulating layer of the signal transmission portion, thereby being exposed for electrical contact, and being positioned such that as the signal armature is urged toward the substrate, the metal contact electrically contacts with the signal transmission electrode at the first signal end of the signal transmission line;

an activation portion comprising an activation armature having a first activation end and a second activation end, the activation portion comprising a top insulator layer and a bottom insulator layer with a conductive layer formed therebetween, where a portion of the conductive layer proximate the substrate activation electrode is formed as an armature activation electrode and where the second activation end of the activation armature is electrically connected with the second end of the activation transmission line through a activation via/anchor formed through the bottom insulating layer so that an activation signal may be applied along the activation transmission line, drawing the armature activation electrode toward the substrate activation electrode, thus drawing the activation portion toward the substrate; and a mechanical linkage connecting the activation portion with the signal transmission portion so that the activation portion and the signal transmission portion move in concert; whereby when an activation signal is applied along the activation transmission line, both the activation portion and the signal transmission portion are drawn toward the substrate to a substantially closed position, where the metal contact of the signal transmission portion electrically contacts the electrode at the first signal end of the signal transmission line.

2. A micro-electro-mechanical switch as set forth in claim 1, wherein the portion of the conducting transmission line exposed for electrical contact is in the form of an protrusion, with the protrusion corresponding to the contact to be made between an input and an output, respectively; whereby the protrusion combined with movement of the activation armature and the signal armature to the substantially closed position provide a conformal contact between the conducting transmission line and the input and the output to form a circuit therebetween.

3. A micro-electro-mechanical switch as set forth in claim 2, wherein the conducting transmission line is formed from a titanium adhesive layer and a gold conductor layer and an anti-diffusion layer therebetween.

4. A micro-electro-mechanical switch as set forth in claim 3, further comprising at least one anchor for mechanically attaching at least one of the following: the second activation end to the substrate and the second signal end to the substrate.

5. A micro-electro-mechanical switch as set forth in claim 1, further comprising at least one anchor for mechanically attaching at least one of the following: the second activation end to the substrate and the second signal end to the substrate.

6. A micro-electro-mechanical switch as set forth in claim 5, wherein the portion of the conducting transmission line exposed for electrical contact is in the form of an protrusion, with the protrusion corresponding to the contact to be made between an input and an output, respectively; whereby the protrusion combined with movement of the activation armature and the signal armature to the substantially closed position provide a conformal contact between the conducting transmission line and the input and the output to form a circuit therebetween.

7. A micro-electro-mechanical switch as set forth in claim 1, wherein the armature activation electrode is positioned above the substrate activation electrode.

8. A micro-electro-mechanical switch as set forth in claim 7, wherein the mechanical linkage and the top and bottom insulator layers of the activation portion and signal transmission portion respectively, are formed of materials selected such that their mechanical and thermal properties provide a desired amount of bowing when the switch is activated.

9. A micro-electro-mechanical switch as set forth in claim 8, wherein the portion of the conducting transmission line exposed for electrical contact is in the form of protrusion, with the protrusion corresponding to the contact to be made between the input and the output, respectively; whereby the protrusion combined with movement of the activation armature and the signal armature to the substantially closed position provide a conformal contact between the conducting transmission line and the input and the output to form a circuit therebetween.

10. A micro-electro-mechanical switch as set forth in claim 9, wherein the conducting transmission line is formed from a titanium adhesive layer and a gold conductor layer and an anti-diffusion layer therebetween.

11. A micro-electro-mechanical switch as set forth in claim 10, further comprising at least one anchor for mechanically attaching at least one of the following: the second activation end to the substrate and the second signal end to the substrate.

12. A micro-electro-mechanical switch as set forth in claim 7, wherein the portion of the conducting transmission line exposed for electrical contact is in the form of protrusion, with the protrusion corresponding to the contact to be made between the input and the output, respectively; whereby the protrusion combined with movement of the activation armature and the signal armature to the substantially closed position provide a conformal contact between the conducting transmission line and the input and the output to form a circuit therebetween.

13. A micro-electro-mechanical switch as set forth in claim 12, wherein the conducting transmission line is formed from a titanium adhesive layer and a gold conductor layer and an anti-diffusion layer therebetween.

14. A micro-electro-mechanical switch as set forth in claim 13, further comprising at least one anchor for mechanically attaching at least one of the following: the second activation end to the substrate and the second signal end to the substrate.

15. A micro-electro-mechanical switch as set forth in claim 7, wherein the conducting transmission line is formed from a titanium adhesive layer and a gold conductor layer and an anti-diffusion layer therebetween.

16. A micro-electro-mechanical switch as set forth in claim 7, further comprising at least one anchor for mechanically attaching at least one of the following: the second activation end to the substrate and the second signal end to the substrate.

17. A micro-electro-mechanical switch as set forth in claim 16, wherein the portion of the conducting transmission line exposed for electrical contact is in the form of protrusion, with the protrusion corresponding to the contact to be made between the input and the output, respectively; whereby the protrusion combined with movement of the activation armature and the signal armature to the substantially closed position provide a conformal contact between the conducting transmission line and the input and the output to form a circuit therebetween.

18. A micro-electro-mechanical switch as set forth in claim 17, wherein the mechanical linkage and the top and bottom insulator layers of the activation portion and signal transmission portion respectively, are formed of materials selected such that their mechanical and thermal properties provide a desired amount of bowing when the switch is activated.

19. A micro-electro-mechanical switch as set forth in claim 7, wherein the bottom insulator layer of the activation portion is formed as a layer on the substrate activation electrode.

20. A micro-electro-mechanical switch as set forth in claim 19, wherein the portion of the conducting transmission line exposed for electrical contact is in the form of protrusion, with the protrusion corresponding to the contact to be made between the input and the output, respectively; whereby the protrusion combined with movement of the activation armature and the signal armature to the substantially closed position provide a conformal contact between the conducting transmission line and the input and the output to form a circuit therebetween.

21. A micro-electro-mechanical switch as set forth in claim 20, wherein the conducting transmission line is formed from a titanium adhesive layer and a gold conductor layer and an anti-diffusion layer therebetween.

22. A micro-electro-mechanical switch as set forth in claim 21, further comprising at least one anchor for mechanically attaching at least one of the following: the second activation end to the substrate and the second signal end to the substrate.

23. A micro-electro-mechanical switch as set forth in claim 22, wherein the mechanical linkage and the top and bottom insulator layers of the activation portion and signal transmission portion respectively, are formed of materials selected such that their mechanical and thermal properties provide a desired amount of bowing when the switch is activated.

24. A micro-electro-mechanical switch as set forth in claim 1, wherein the mechanical linkage and the top and bottom insulator layers of the activation portion and signal transmission portion respectively are formed of materials selected such that their mechanical and thermal properties provide a desired amount of bowing when the switch is activated.

25. A method of transmitting a radio frequency through a single contact micro-electro-mechanical switch comprising acts of:

transmitting an input signal through an input line located on top of a substrate;

communicating the signal through a substrate electrode to an activation armature electrode located near but separated from the input line;

electro-mechanically activating the switch;

moving a mechanically linked activation armature and a signal armature to a substantially closed position;

transmitting the signal across a conducting transmission line positioned over the input line and output line positioned in proximity to the signal armature;

contacting at least a portion of the conducting transmission line exposed for conformal contact with the input and output lines; thereby enabling electricity to flow by closing a circuit between the output line and the input line.

26. A method of transmitting a radio frequency through a single contact micro-electro-mechanical switch as set forth in claim 25, further comprising an act of contacting an protrusion, wherein the contacting corresponds to the contact to be made between the input and the output; whereby the protrusion combined with movement of the activation armature and the signal armature to the substantially closed position provides a conformal contact between the conducting transmission line and the input and the output to form a circuit therebetween.

27. A method of transmitting a radio frequency through a single contact micro-electro-mechanical switch as set forth in claim 26, wherein the conducting transmission line is formed from a titanium adhesive layer and a gold conductor layer and an anti-diffusion layer therebetween.

28. A method of transmitting a radio frequency through a single contact micro-electro-mechanical switch as set forth in claim 27, further comprising an act of attaching at least one the following: an end of the activation armature to the substrate and a signal end of the signal armature to the substrate, wherein attaching the activation end includes acts of connecting to a radio frequency line and diffusing heat through an anchoring comprised of a metal material.

29. A method of transmitting a radio frequency through a single contact micro-electro-mechanical switch as set forth in claim 28, further comprising an act of passing a signal through an activation armature electrode to the conducting line.

30. A method of transmitting a radio frequency through a single contact micro-electro-mechanical switch as set forth in claim 29, further comprising act of: activating the switch and creating a desired amount of bowing of the activation armature and the signal armature to facilitate the contacting of at least a portion of the conducting transmission line.

31. A method of transmitting a radio frequency through a single contact micro-electro-mechanical switch as set forth in claim 25, wherein the conducting transmission line is formed from a titanium adhesive layer and a gold conductor layer and an anti-diffusion layer therebetween.

32. A method of transmitting a radio frequency through a single contact micro-electro-mechanical switch as set forth in claim 25 further comprising an act of attaching at least one of the following: an end of the activation armature to the substrate and a signal end of the signal armature to the substrate, wherein attaching the activation end includes acts of connecting to a radio frequency line and diffusing heat through an anchor comprised of a metal material.

33. A method of transmitting a radio frequency through a single contact micro-electro-mechanical switch as set forth in claim 25 further comprising an act of passing a signal through an activation armature electrode to the conducting line.

34. A method of transmitting a radio frequency through a single contact micro-electro-mechanical switch as set forth in claim 25 further comprising an act of: activating the switch and creating a desired amount of bowing of the activation armature and the signal armature to facilitate the contacting of at least a portion of the conducting transmission line.

* * * * *